US006386598B1

(12) United States Patent
Dykstra et al.

(10) Patent No.: US 6,386,598 B1
(45) Date of Patent: May 14, 2002

(54) LOCKING POWER CLAMP

(75) Inventors: Henry Dykstra, Hartland; Douglas D. Colby, Clarkston, both of MI (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/564,154

(22) Filed: May 3, 2000

Related U.S. Application Data

(60) Provisional application No. 60/152,711, filed on Sep. 7, 1999.

(51) Int. Cl.[7] ..... E05C 19/12; E05C 5/00; B65D 45/00; B65D 47/00

(52) U.S. Cl. ..... 292/113; 292/201; 220/315

(58) Field of Search ..... 24/463, 489, 490, 24/492; 296/50, 56; 292/63, 64, 66, 71, 113, 144, 201, 247; 220/263, 264, 315

(56) References Cited

U.S. PATENT DOCUMENTS 2,984,176 A * 5/1961 Sommer et al. ..... 83/698.71
3,545,050 A * 12/1970 Blatt et al. ..... 24/457
3,722,936 A * 3/1973 Stubert ..... 292/64
3,885,932 A * 5/1975 Moore, Jr. et al. ..... 55/314
3,888,528 A * 6/1975 Jericijo ..... 292/256.5
3,990,739 A * 11/1976 Head ..... 296/56
4,017,281 A * 4/1977 Johnstone ..... 55/334
4,155,586 A * 5/1979 Flynn ..... 296/56
4,222,404 A * 9/1980 Flynn ..... 137/205
4,538,951 A * 9/1985 Yeazel et al. ..... 414/407
4,762,345 A * 8/1988 Stluka et al. ..... 292/26
5,287,602 A * 2/1994 Dykstra ..... 24/463
6,105,947 A * 8/2000 Dykstra ..... 269/24

* cited by examiner

*Primary Examiner*—Joseph D. Pape
*Assistant Examiner*—Hilary Gutman
(74) *Attorney, Agent, or Firm*—Dinnin & Dunn, P.C.

(57) ABSTRACT

A locking power clamp assembly for repetitive use to uniformly and securely clamp a closure member over a container opening is disclosed. The clamp assembly includes a clamp arm member having a clamping contact surface. The clamping arm member has an elongated dimension and is capable of generally rotational movement such that when the clamp assembly is opened the clamp arm member will move in a generally perpendicular direction away from the plane of the closure member. The clamp arm member also moves in a radial direction away from the peripheral edge of the closure member. The clamp assembly further includes at least one frame member. The clamp assembly also includes at least two link arm members each being of a different length. The clamp assembly uses a fluid operated piston and cylinder assembly with the piston being connected to one of the link arm members. The clamp assembly is connected to the frame member. The clamp assembly has a rotator member secured to the frame member to support and assist movement of the clamp arm member.

10 Claims, 4 Drawing Sheets

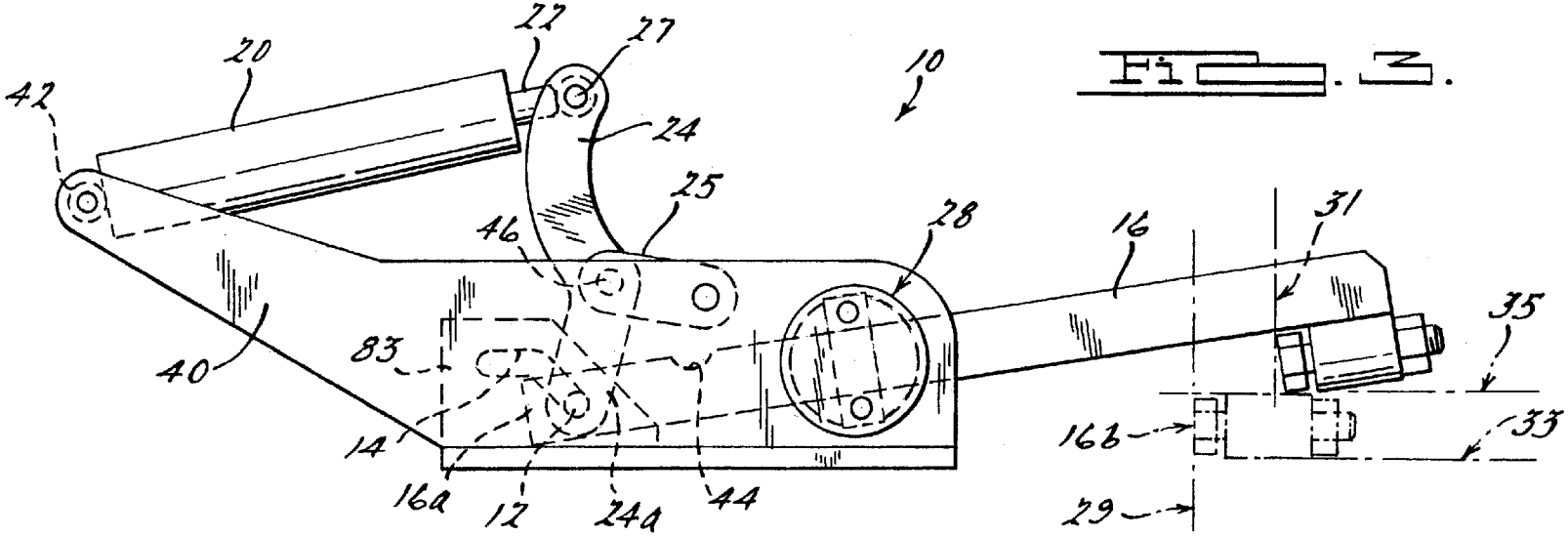
10
16
16B
16A
28
27
24
25
22
20
42
40
14
12
44
24A
46
83
31
35
33
29
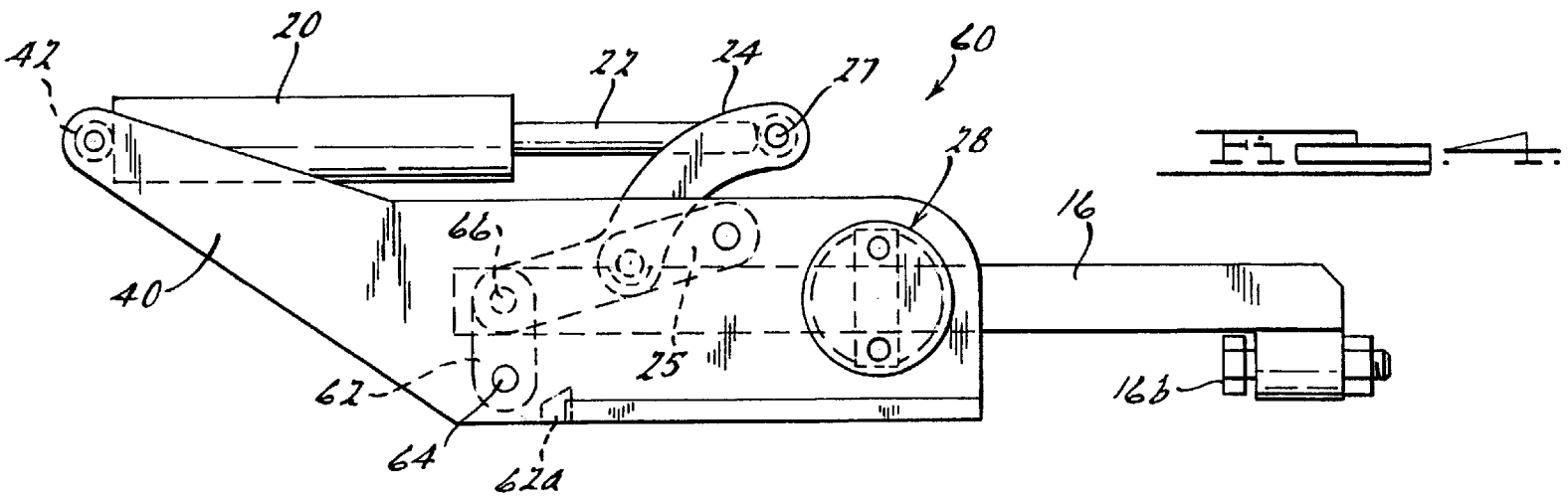
60
16
16B
28
27
24
25
22
20
42
40
62
62A
64
66

LOCKING POWER CLAMP

This application is a continuation of and claims the benefit of applicant's earlier U.S. Provisional application No. 60/152,711 filed Sep. 7, 1999.

BACKGROUND OF THE INVENTION

This invention broadly relates to a novel locking power clamp uniquely designed for use in holding a door of a container in a closed position. More specifically, the invention relates to a special new locking power clamp suitable for use with industrial vacuum loader trucks, wherein a clamping system is required to hold the rear door of the vacuum loader in a tightly closed and sealed position.

There has been a problem involved with prior industrial vacuum loader trucks which utilize a large (sometimes circular) door at the rear of the vacuum loader, with the door being held in a closed position when the vacuum system of the truck is being utilized. The rear doors on these vacuum loaders are provided with a peripheral sealing member such as a rubber or elastomeric peripheral seal, which seals the door into a generally airtight position when the door is closed. Previous clamping systems used to hold the door in a closed position have been unsatisfactory, such as for example, due to the fact that they exert uneven clamping loads on the seal, which in many instances causes the seal to be unevenly applied. In addition, the previous clamping mechanisms did not provide easy on-off positioning, such that when it was desired to open the rear door of the vacuum loader truck the clamping system could be easily and economically withdrawn from the periphery of the door; and then, vice-versa, easily and rapidly put back into a closed clamping position following closure of the door mechanism.

The state-of-the-art in this area is generally shown by commonly assigned co-pending U.S. patent application Ser. No. 08/916065 filed Aug. 21, 1997; and, by earlier U.S. Pat. No. 5,287,602 issued Feb. 22, 1994 and entitled "Powered Toggle Latch."

SUMMARY OF THE INVENTION

Briefly stated, the present invention consists of a new locking power clamp assembly for repetitive use in uniformly and securely clamping a closure member over a container opening, said clamp assembly comprising: a clamp arm member having a clamping contact surface thereon, said clamp arm member being of elongated dimension and being capable of generally rotational movement, such that when the clamp assembly is opened, the clamp arm member will move in a generally perpendicular direction away from the plane of the closure member and also will move in a radial direction away from a peripheral edge of the closure member, at least one frame member, at least two link arm members, each being of different length, a fluid operated piston and cylinder assembly, with the piston being connected to one of the link arm members, and the cylinder being connected to said frame member, a rotator member secured to the frame member to support and assist proper movement of the clamp arm member.

BRIEF DESCRIPTION OF THE DRAWINGS

FIG. 3 illustrates a similar side view of FIG. 1, except that the clamping mechanism is shown with the clamp arm in withdrawn or unclamped position;

FIG. 4 illustrates another embodiment of the locking power clamp of the invention, wherein a series of link arms are used to form the actuating movement of the clamp mechanism;

DESCRIPTION OF PREFERRED EMBODIMENTS

Like drawing numerals in different drawing Figures indicate like elements.

Figure 1:
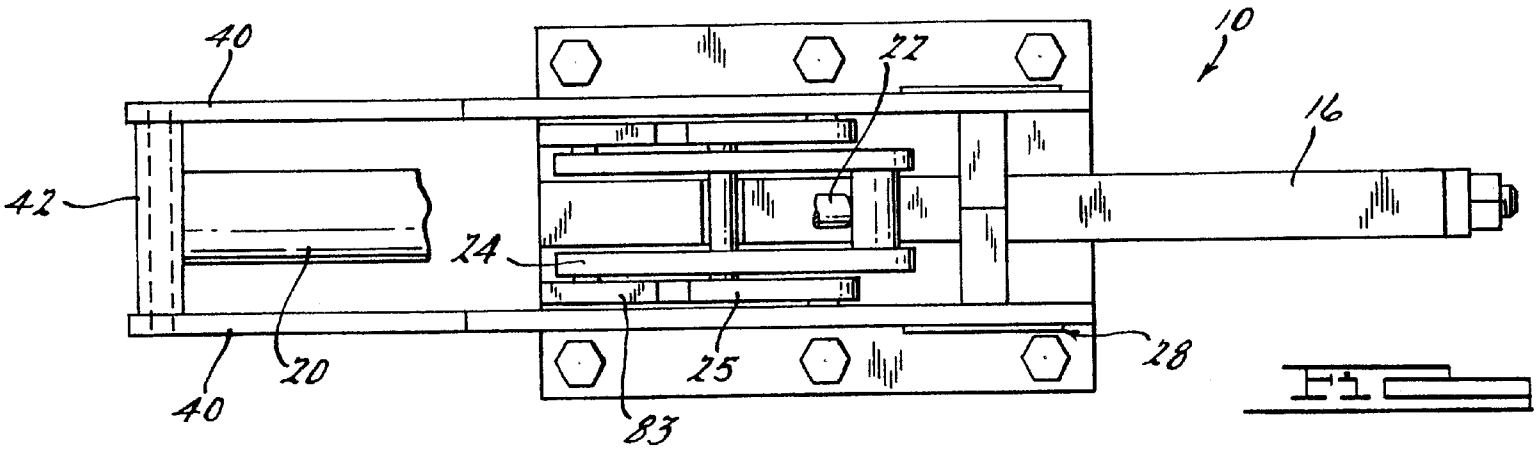
FIG. 1 illustrates a locking power clamp assembly in accordance with the invention, in top view format.
Figure 2:
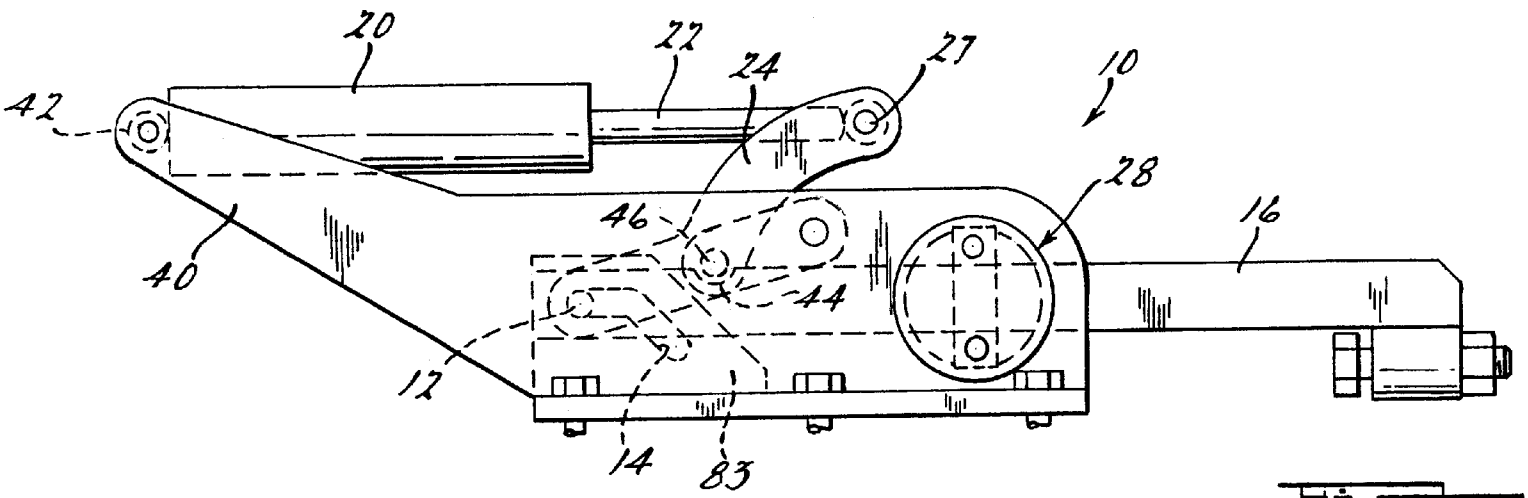
FIG. 2 illustrates a side view of FIG. 1.

The locking power clamp is designated 10 in FIGS. 1, 2 and 3. The clamp mechanism as shown in FIGS. 1, 2 and 3 uses a sliding pivot pin designated 12 which moves within a slot designated 14 when the clamp mechanism is actuated or deactuated for purposes of moving the clamp arm 16 to an open position as shown in FIG. 3 relative, to the closed position of the clamp arm 16 as indicated in Figures in 1 and 2.

Operation of the locking power clamp mechanism illustrated in FIGS. 1, 2 and 3 is generally as follows: First with respect to FIG. 2, this Figure shows the clamp mechanism 10 in closed or fully clamped position. In this position the cylinder 20 and piston rod 22 are in fully extended position which thereby pushes or moves the link arm 24 into a fully forward position. This full forward position is the opposite of the fully withdrawn position of link arm 24 as shown in FIG. 3, when the cylinder 20 and piston rod 22 are in full retracted position.

In the retracted position of the linked arm 24, as shown in FIG. 3, pivot arm 25 is also in retracted position and this has caused the lower portion 24*a* of link arm 24 to be moved in a forward position (or to the right) as shown in the drawing FIG. 3, thus causing the pivot pin or slide pin 12 to move forward or to the right in the slot 14. This moves the rear 16*a* of the clamping arm 16 into a lower position, which then pivots the clamp arm 16 into an upward and withdrawn position, due to its rotation about the rotator member 28; and also simultaneously moves the clamp arm 16 into an outer position which is withdrawn from the actual closed clamped position shown by the dotted at line 29 in FIG. 3. The fully open position of the clamp member surface is designated by the dotted line at 31. Thus in terms of left to right opening movement, the distance from fully clamped position 29 to open position 31 is broadly stated about one-half inch to six inches or more, and preferably this extent of movement would be three-quarters of an inch to one and a half inches. With most preferred results being obtained when the amount of movement from closed position 29 to open position 31 is approximately one inch. At the same time, movement of the clamp surface 16*b* in an up and down (i.e., radial) direction is designated by the distance between the dotted line at 33 and the dotted line at 35. This distance between position 33 and position 35, broadly stated, can be from approximately one-half inch to about five inches or more, with preferred results being obtained when the distance between position 33 and position 35 is kept to a dimension between about three-quarters inch and one and one-quarter inch. With best results being obtained when the distance between position 33 and position 35 is kept at about one inch.

The clamping mechanism of FIGS. 1, 2 and 3 is also designed and constructed to use the bracket member 40, which acts as a support for the internal working of the clamping mechanism and for housing of the cylinder 20 and piston rod 22 which is mounted at the rotational mount position designated 42.

In FIG. 3 a groove or indent 44 is shown in the rearward portion of the clamp arm 16. This groove 44 is for seating of the pivot pin 46 when the piston rod 22 is pushed into a forward position, to thereby seat the pin member 46 in the groove 44 when the linkage system reaches a slightly over center or locked position.

Figures 5, 6, 7, 8:
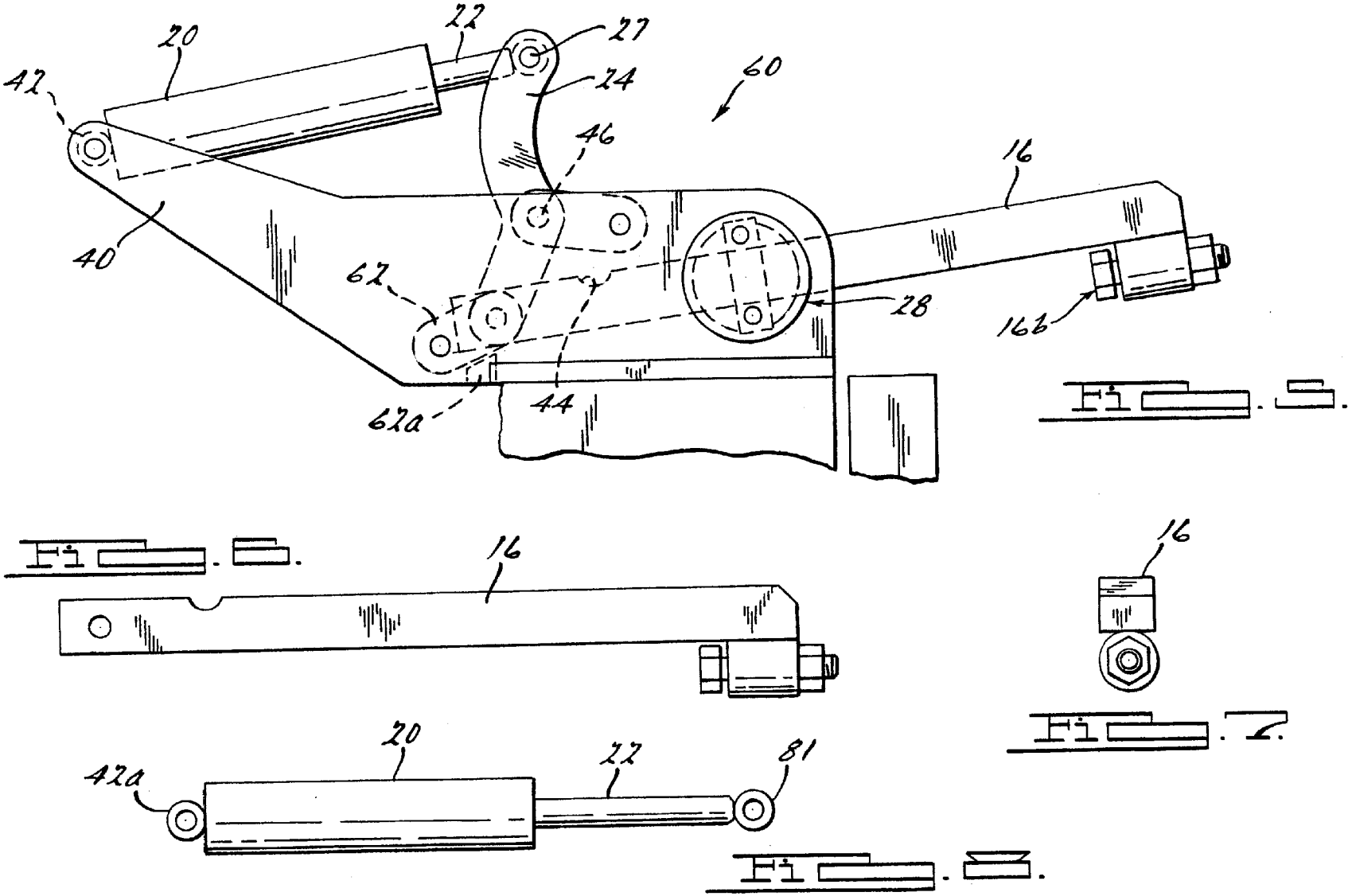
FIG. 5 shows a similar view of the clamp mechanism of FIG. 4, with the exception that the clamping mechanism is shown in withdrawn or unclamped position.
FIG. 6 shows the clamp arm used in the clamp mechanism of either FIG. 2 or FIG. 4.
FIG. 7 shows an end view of the clamp arm of FIG. 6.
FIG. 8 shows a piston and cylinder mechanism used in the clamp mechanism of either FIGS. 1–3 or FIGS. 4–5.
Figure 9:
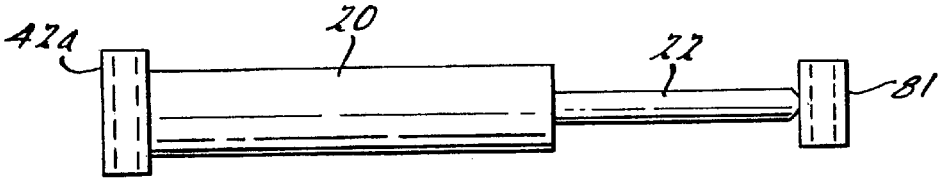
FIG. 9 shows a top view of the piston and cylinder mechanism of FIG. 8.

FIGS. 4–5 illustrate a similar locking power clamp mechanism to that shown in FIGS. 1–3, except that in FIGS. 4–5 the locking power clamp mechanism designated 60 utilizes a linkage arm system which is supported by rotational pin members as opposed to a sliding pin/slot arrangement as shown at 12, 14 in FIGS. 2–3. As shown in FIGS. 4–5, the clamping mechanism 60 differs from clamp mechanism 10 in that clamp mechanism 60 utilizes a third link arm designated 62, which pivots about the point 64, such that pivot pin 66 at the other end of link number 62 has a movement range which is roughly similar to the movement range of the sliding pivot pin 12 shown in FIG. 3.

A small block or stop member 62*a* prevents link arm 62 from going too far in a downward direction (i.e., prevents link 62 from going over center) and thus avoids locking up the clamp mechanism in the open position.

The range of movement of the clamping surface 16*b* and clamp arm 16 (in FIG. 4) is roughly the same as the dimension or range of movement specified above with respect to the clamp arm 16 shown in FIG. 3.

The advantages and disadvantages of utilizing a link arm 62 movement arrangement as shown in FIG. 4, relative to the sliding pivot pin 12 and slot portion 14 shown in FIG. 3, are as follows:

A pin and slot type mechanism as shown in FIGS. 1, 2 and 3 is a preferred embodiment for many applications of the invention. For example, with a pin and slot type mechanism there is a preferred or favorable motion of the clamp arm 16; that is, the tendency of the clamp arm is to move straight out when initially opening the clamp mechanism. This movement is then followed by a radial outward movement along the direction of the dotted line 31 as shown in FIG. 3.

In other applications an all link arm system of construction, as shown in FIGS. 4–5, is preferred. The all link arm construction is advantageous from the standpoint that contaminants, rocks, dirt, sand etc. are much less susceptible to interrupting with, or interfering, or preventing the movement of the mechanism as shown in FIGS. 4–5. Also, the all link arm system as shown in FIGS. 4–5 is in many instances more economical and efficient to produce.

Figure 10:
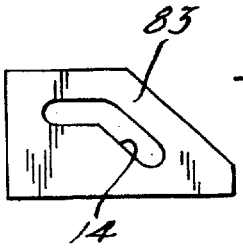
FIG. 10 shows a bracket member with sliding slot aperture therein, used for the linkage system in the clamp mechanism of FIG. 2.
Figure 11:
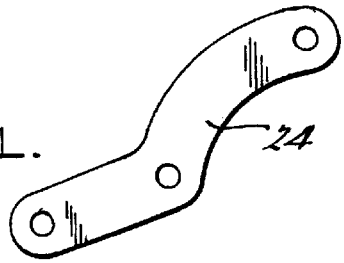
FIG. 11 shows a linkage arm used in the clamp mechanism of FIGS. 1–3 or 4–5.
Figure 12:
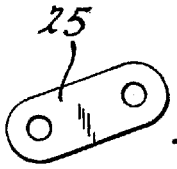
FIG. 12 shows a linkage member utilized in the clamp mechanism of FIGS. 1–2 or FIGS. 4–5.

FIGS. 6–15 shown various individual elements, i.e., mechanical members, used in the clamp mechanisms of FIGS. 1–3 or FIGS. 4–5. For example, FIG. 6 shows a detailed drawing of the clamp arm 16 used in FIGS. 1–5; FIG. 7 shows an end view of the clamp arm member 16. FIG. 8 shows a detailed view of the cylinder 20 and piston rod 22 associated therewith, as well as the mounting member 42*a* which is pivotally or rotationally connected to the rotational mount position 42 shown in FIGS. 1–5. The opposite end of the cylinder 20—piston 22 also includes a mounting ring designated 81 which is connected with pin 27 for rotational connection with the link arm 24. FIG. 10 shows the member 83 which houses the slot portion 14 as used in the clamping mechanism of FIG. 3. FIG. 11 shows the detail drawing of the linkage arm 24, and FIG. 12 shows a detailed view of the link arm 25 used in FIGS. 1–3 and FIGS. 4–5.

Figure 13:
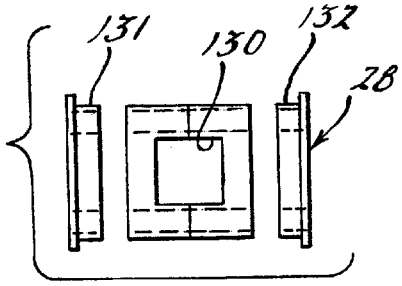
FIG. 13 shows a rotator member used in the clamp mechanism of FIGS. 1–3 or clamp mechanism of FIGS. 4–5.
Figure 14:
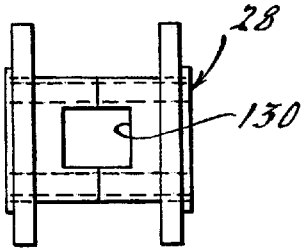
FIG. 14 shows a top view of the rotator member of FIG. 13.
Figure 15:
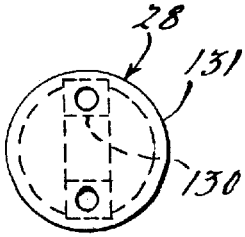
FIG. 15 shows a side view of FIG. 13.

FIGS. 13, 14 and 15 show the rotator member 28 which houses and supports the clamp arm 16, which passes through the aperture 130 shown in the middle of the rotator member and which is utilized to support the clamp arm during its reciprocating movement. The outer rings 131 and 132 act to support the rotator member for reciprocating movement as the clamp arm 16 is moved back and forth between a fully clamped position and a withdrawn position.

It should also be recognized that the clamp assembly herein can be operated manually as well as by hydraulic (or pneumatic) cylinder and piston. For manual operation an extension (in an upward direction) would be added to the link arm 24. This upward extension would then be grasped and manually moved back and forth to open and close the clamp assembly.

While it be apparent that the preferred embodiments of the invention disclosed above are well calculated to fulfill the objects, benefits and advantages of the invention, it will be appreciated that the invention is susceptible to modification, variation and change without departing from the proper scope or fair meaning of the sub-joined claims.

What is claimed is:

1. A locking power clamp assembly for repetitive use in uniformly and securely clamping a closure member over a container opening, said clamp assembly comprising:

a clamp arm member having a clamping contact surface thereon, said clamp arm member being of elongated dimension and being capable of generally rotational movement, such that when the clamp assembly is opened, the clamp arm member will move in a generally perpendicular direction away from the plane of the closure member and also will move in a radial direction away from a peripheral edge of the closure member, at least one frame member, at least two link arm members, each being of different length, a fluid operated piston and cylinder assembly, with a piston being connected to one of the link arm members, and a cylinder being connected to said frame member, and a rotator member secured to the frame member to support and assist proper movement of the clamp arm member, said rotator member having a central aperture for receiving said clamp arm in sliding rotation, said rotator member having a pair of outer rings for receiving said frame member in rotational relation.

2. The invention of claim 1 wherein, a plurality of about 2 to about 10 of said clamp assemblies are utilized to secure a rear door of a vacuum loader truck in a sealed closed position.

3. The invention of claim 2 wherein, during opening of the clamp assembly, outward perpendicular movement of said clamping contact surface is about one inch, and simultaneous movement in said radial direction is about one inch.

4. The invention of claim 1 wherein, at least one of said link arm members has a pivot pin there through which slides back and forth in a slot during opening and closing of the clamp assembly.

5. The invention of claim 3 wherein, at least one of said link arm members has a pivot pin there through which slides back and forth in a slot during opening and closing of the clamp assembly.

6. A vacuum loader truck containing a rear closure door with a peripheral seal member, said door and seal member generally being located at one end of a large vacuum chamber on said truck, wherein said vacuum loader truck contains a plurality of clamp assemblies to secure said door in a closed position, said clamp assemblies including:

a clamp arm member having a clamping contact surface thereon, said clamp arm member being of elongated dimension and being capable of generally rotational movement, such that when the clamp assembly is opened, the clamp arm member will move in a generally perpendicular direction away from the plate of the closure door and will move in a radial direction away from a peripheral edge of the closure door, at least one frame member, at least two link arm members, each being of different length, a fluid operated piston and cylinder assembly, with a piston being connected to one of the link arm members, and a cylinder being connected to said frame member, and a rotator member secured to the frame member to support and assist proper movement of the clamp arm member, said rotator member having a central aperture for receiving said clamp arm in sliding rotation, said rotator member having a pair of outer rings for receiving said frame member in rotational relation.

7. The invention of claim 6 wherein, a plurality of about 2 to about 10 of said clamp assemblies are utilized to secure said rear door of said vacuum loader truck in said closed position.

8. The invention of claim 6 wherein, during opening of the clamp assembly, outward perpendicular movement of said clamping contact surface is about one inch, and simultaneous movement in said radial direction is about one inch.

9. The invention of claim 6 wherein, at least one of said link arm members has a pivot pin there through which slides back and forth in a slot during opening and closing of the clamp assembly.

10. The invention of claim 7 wherein, at least one of said link arm members has a pivot pin there through which slides back and forth in a slot during opening and closing of the clamp assembly.

* * * * *

UNITED STATES PATENT AND TRADEMARK OFFICE

CERTIFICATE OF CORRECTION

PATENT NO. : 6,386,598 B1 
DATED : May 14, 2002
INVENTOR(S) : Henry Dykstra and Douglas Colby It is certified that error appears in the above-identified patent and that said Letters Patent is hereby corrected as shown below:

Column 5,
Line 32, please delete “plate” and insert -- plane --

Signed and Sealed this

Fifteenth Day of October, 2002

*Attest:*

*Attesting Officer*

JAMES E. ROGAN
*Director of the United States Patent and Trademark Office*